US008704729B2

(12) United States Patent
Tucek et al.

(10) Patent No.: US 8,704,729 B2
(45) **Date of Patent: *Apr. 22, 2014**

(54) EXTENDED VARYING ANGLE ANTENNA FOR ELECTROMAGNETIC RADIATION DISSIPATION DEVICE

(76) Inventors: Kevin B Tucek, McKinney, TX (US); Steven C Shanks, McKinney, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/549,142

(22) Filed: Jul. 13, 2012

(65) Prior Publication Data

US 2012/0280889 A1 Nov. 8, 2012

Related U.S. Application Data

(63) Continuation-in-part of application No. 13/094,166, filed on Apr. 26, 2011, which is a continuation of application No. 12/868,287, filed on Aug. 25, 2010, now Pat. No. 7,973,736, which is a continuation of application No. 12/215,231, filed on Jun. 26, 2008, now Pat. No. 7,800,554.

(51) Int. Cl.

| | |
|---|---|
| ***H01Q 1/38*** | (2006.01) |
| ***H01Q 5/00*** | (2006.01) |
| ***H01Q 9/04*** | (2006.01) |
| ***H01Q 1/36*** | (2006.01) |

(52) U.S. Cl.
USPC ..... 343/895; 343/700 MS; 343/702

(58) Field of Classification Search
USPC ..... 343/700 MS, 895, 702
See application file for complete search history.

(56) References Cited

U.S. PATENT DOCUMENTS

| | | | | |
|---|---|---|---|---|
| 5,613,221 | A * | 3/1997 | Hunt | 455/575.5 |
| 6,504,511 | B2 * | 1/2003 | Andersson | 343/702 |
| 6,963,309 | B2 * | 11/2005 | Andersson et al. | 343/702 |
| 7,365,688 | B2 * | 4/2008 | Tseng et al. | 343/700 MS |
| 7,408,512 | B1 * | 8/2008 | Rodenbeck et al. | 343/700 MS |
| 7,667,663 | B2 * | 2/2010 | Hsiao et al. | 343/850 |
| 2002/0075189 | A1 * | 6/2002 | Carillo et al. | 343/702 |
| 2004/0245473 | A1 * | 12/2004 | Takayama et al. | 250/370.01 |
| 2008/0238778 | A1 * | 10/2008 | Ge et al. | 343/700 MS |
| 2011/0090126 | A1 * | 4/2011 | Szini et al. | 343/702 |

FOREIGN PATENT DOCUMENTS

| | | | |
|---|---|---|---|
| EP | 0923158 | A2 | 6/1999 |
| EP | 1701408 | A1 | 9/2006 |
| WO | 01/08260 | A1 | 2/2001 |
| WO | 2008/008078 | A1 | 1/2008 |

* cited by examiner

*Primary Examiner* — Dameon Levi
*Assistant Examiner* — Jennifer F Hu
(74) *Attorney, Agent, or Firm* — Etherton Law Group, LLC

(57) ABSTRACT

An extended varying angle antenna is used with an electromagnetic radiation dissipation device to reduce exposure to electromagnetic radiation. The extended antenna captures radiation from an active emission source, such as a transmitting cellular telephone. The device converts the captured radiation into an electric current and dissipates the collected current by operating the dissipation device. The extended antenna is a printed circuit board trace antenna comprising a microstrip having a meandering portion with several serially connected meandering segments and an extended portion. One or more meandering segments include 90-degree bends in the microstrip, and one or more meandering segments include bends of more and less than 90 degrees. The extended portion includes two or more parallel horizontal portions and at least one vertical portion, all connected by 90-degree bends. The extension is connected to the meandering portion or to the dissipation device to provide additional current to the dissipation device.

9 Claims, 6 Drawing Sheets

EXTENDED VARYING ANGLE ANTENNA FOR ELECTROMAGNETIC RADIATION DISSIPATION DEVICE

CROSS-REFERENCE TO RELATED APPLICATIONS

This application is a continuation-in-part of co-pending U.S. application Ser. No. 13/094,166 filed Apr. 26, 2011, which is a continuation of U.S. application Ser. No. 12/868,287, filed Aug. 25, 2010, which issued as U.S. Pat. No. 7,973,736 on Jul. 5, 2011, which is a continuation of application Ser. No. 12/215,231, filed Jun. 26, 2008, which issued as U.S. Pat. No. 7,800,554 on Sep. 21, 2010.

FIELD OF INVENTION

This invention relates generally to antennas that receive electromagnetic radiation. This invention relates more specifically to antennas adapted to be placed in the vicinity of an active electromagnetic radiation emission source to reduce undesirable radiation that emanates from the active emission source.

BACKGROUND

Many devices transmit electromagnetic radiation when in operation. For example, wireless communication devices intentionally emanate electromagnetic radiation when transmitting. Other devices transmit inadvertently, for example when a microwave oven is cooking, microwaves may inadvertently escape the oven. The widespread acceptance and use of hand-held, portable cellular telephones has been accompanied by increasing concern regarding possible harmful effects of such radiation. New hand-held cellular telephones typically have an elongated housing with an internal antenna, and older hand-held cellular telephones typically have an elongated housing with an antenna extending upward vertically from the housing. When using either type of telephone, the user's head comes into close proximity to the antenna when his head is placed adjacent to the cellular telephone. The antenna emanates radiation when the cellular telephone is transmitting, and such an antenna is referred to herein as a transmitting antenna. Thus, when the user is talking, the device is emanating radiation from the transmitting antenna, and a substantial amount of electromagnetic energy is projected directly onto the user's head at close range.

Each cellular telephone has to meet certain government guidelines as to the amount of radiation the user is exposed to. The amount of RF radiation absorbed by the body is measured in units known as SARs, or specific absorption rates. It would be desirable to reduce the SARs without significantly adversely affecting the operation of the telephone.

There have been attempts to shield the body from the electromagnetic energy emanating from the transmitting antenna. For example, U.S. Pat. No. 5,613,221 issued to Hunt discloses a conductive strip placed between the transmitting antenna and the user's head, to conduct radiation away from the user's head. There have also been some attempts to move the source of electromagnetic energy away from the body by changing the transmitting antenna location or radiation pattern. For example, U.S. Pat. No. 6,356,773 issued to Rinot removes the transmitting antenna from the phone and places it atop the user's head. An insulating shield is disposed between the transmitting antenna and the user's head, like a cap, for blocking emissions so that they do not penetrate through to the user. U.S. Pat. No. 6,031,495 issued to Simmons et alia uses a conducting strip between two poles of a transmitting antenna to create an end fire bi-directional pattern away from the user's head. Others have tried to reduce exposure to harmful emission by canceling the radiation. For example, U.S. Pat. No. 6,314,277 issued to Hsu et alia, is a cellular telephone antenna that cancels transmitted radiation of the cellular telephone with an absorbent directional shield by feeding the signal back into the cellular telephone.

One method of reducing electromagnetic radiation is to capture the radiation with an antenna, convert it to an electric current, and then dissipate the current, as described in U.S. Published Patent Application 2008/0014872. Antennas, however, are designed to receive RF signals in particular frequency bands, and cellular telephones operate generally in one or more of four different bands. For example, in Europe, GSM cellular telephones operate in the 900 MHz and 1800 MHz bands. In the United States, GSM and CDMA cellular telephones operate in the 850 MHz or 1900 MHz bands. It would be desirable to design an antenna for electromagnetic dissipation devices that is capable of capturing radiation across most or all of the cellular telephone frequency bands.

Meander antennas have become popular for receiving cellular telephone signals due to their small size, light weight, ease of fabrication, and omni-directional radiation patterns. Meander antennas generally comprise a folded wire printed on a dielectric substrate such as a printed circuit board (PCB). Meander antennas have resonance in a particular frequency band in a much smaller space than many other antenna designs. The resonant frequency of a meander antenna decreases as the total wire length of the meander antenna element increases. In addition, if the turns in the meander antenna are very close so as to have strong coupling, there can also be capacitive loading of the antenna, which will increase bandwidth. Total antenna geometry, wire length, and layout must be optimized for each given antenna's purpose. It would be desirable to design a meander antenna for use with an electromagnetic radiation dissipation device that is effective across the cellular telephone frequency bands.

Therefore, it is an object of this invention to provide an antenna design to be used with a device that decreases the SARs to the user of an active emission source without significantly adversely affecting the desired performance of the emission source. It is a particular object to provide an antenna design specifically tuned for reducing the undesirable radiation a user is exposed to from a cellular telephone. It is a further object to provide an antenna design that can capture electromagnetic radiation from a cellular telephone operating in any of the four predominant frequency bands allotted for cellular telephone communication. It is another object to provide an antenna design that generates enough current to power a device that notifies the user that electromagnetic radiation is present.

SUMMARY OF THE INVENTION

The present invention is an extended varying angle antenna to be used with an electromagnetic radiation dissipation device that reduces exposure to undesirable electromagnetic radiation or with a device that indicates the presence of known or unknown electromagnetic radiation. The dissipation device uses a varying angle antenna having a meandering portion with an extension to capture radiation from an active emission source, such as a cellular telephone when it is transmitting. The device converts the captured radiation into an electric current and dissipates the collected current by spending it to operate a dissipation assembly, which may be a thermal, mechanical, chemical or electrical device, or combination thereof. The extended antenna generates a larger electric current than the existing meandering antenna, enabling the dissipation device to operate the dissipation assembly at a higher current and serving to better notify the user that electromagnetic radiation is present or that the device used to reduce SARs is working.

The extended varying angle antenna is a PCB trace antenna comprising a microstrip having a meandering portion with several serially connected meandering segments and an extension. In the meandering portion, one or more meandering segments include 90-degree bends in the microstrip, and one or more meandering segments include bends of more and less than 90 degrees. Horizontal portions of the microstrip in the meandering portion are all parallel, while vertical portions of the microstrip in the meandering portion can be parallel or angled, depending on the bend angle. Additionally, near the center of the meandering portion, the microstrip segments are narrower than the microstrip segments near the ends of the meandering portion. In general, the meandering segments include varying angles, which maximizes the operation of the antenna for absorbing undesirable electromagnetic radiation from cellular telephones. The extension is also a microstrip, having at least one horizontal portion and at least one vertical portion, connected by 90-degree bends. The extension may be integrated into the meandering portion, connected in series to the meandering portion, or connected in parallel to the dissipation device, as desired, to provide additional current to the dissipation device than what the meandering portion provides. In a preferred embodiment, the meandering portion is about 3.8 inches long and the extension adds about 2.4 inches, for a total microstrip length of about 6.2 inches.

DETAILED DESCRIPTION OF THE INVENTION

Figure 1:
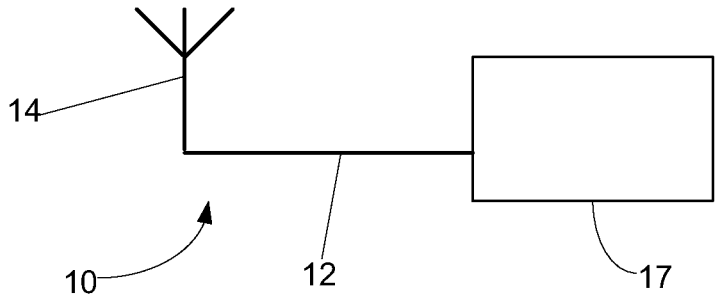
FIG. 1 is a block diagram illustrating the antenna of the present invention in cooperation with an electromagnetic radiation dissipation device.
Figure 2:
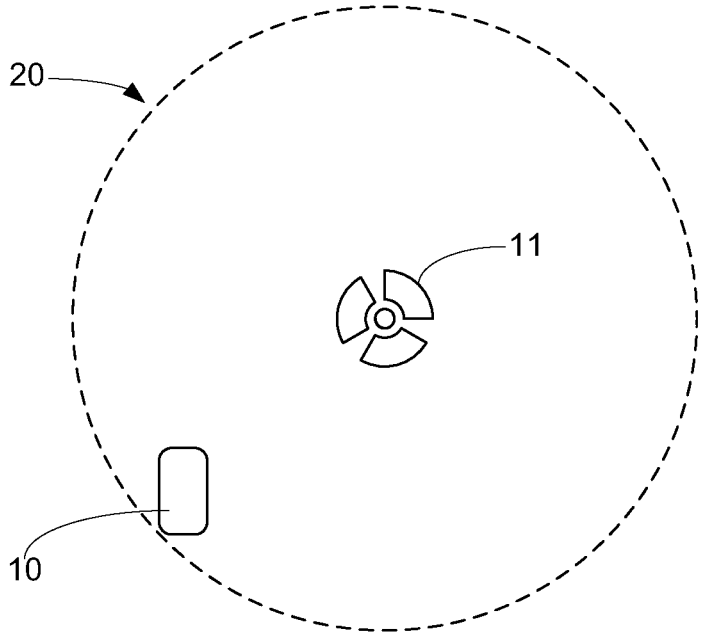
FIG. 2 is block diagram illustrating an electromagnetic radiation dissipation device incorporating the antenna of the present invention positioned near an emission source.

The present invention is an extended varying angle antenna 14 for use with an electromagnetic radiation dissipation device 10 that reduces undesirable radiation. Dissipation device 10 comprises extended antenna 14 and a dissipation assembly 17, as illustrated in FIG. 1. When an emission source 11, as shown in FIG. 2, is in operation it transmits electromagnetic radiation. When antenna 14 is bombarded by the radiation, electrons are stirred up in the antenna 14, generating an electron flow (current). This current is drained from the target antenna 14 with a conductor 12 and moved to a dissipation assembly 17, which spends the current by operating one or more electrical, mechanical or thermal devices. For small emission sources, the current is small and the conductor may be as simple as a wire or printed circuit board lead. For larger emission sources, a heavier-duty conductor may be required.

As is known in the art, an antenna is any conducting mass that functions as a receiver or collector of electromagnetic energy. Additionally, antennas have a number of important parameters; those of most interest include the gain, radiation pattern, bandwidth and polarization. In a receiving antenna, the applied electromagnetic field is distributed throughout the entire length of the antenna to receive the undesirable radiation. If the receiving antenna that the signal strikes has a certain length relative to the wavelength of the received radiation, the induced current will be much stronger. The desired length of the antenna can be determined by using the well-known equation:

$$(\lambda)(f)=c$$

where $\lambda$ is the wavelength of the incident radiation, f is the frequency of the incident radiation, and c is the speed of light. For example, if a signal at 1900 MHz travels through the air, it completes a cycle in approximately 32 cm. If the signal strikes a 32 cm antenna or certain fractions of it (½ or ¼ or 1/16 wavelength), then the induced current will be much higher than if the signal struck a target antenna that was not some appreciable fraction of the wavelength.

Typically, cellular phones and other wireless communications technologies such as PCS, G3 or Bluetooth® emit radiation in the radio or microwave ranges, or both, when transmitting. These and other consumer products often emit multiple wavelengths (at correspondent frequencies). Cellular telephones, in particular, emit radiation in the 450 MHz, 850 MHz, 900 MHz, 1800 MHz, and 1900 MHz ranges when transmitting. This means that the extended varying angle antenna 14 must perform well over a range of frequencies. The corresponding wavelengths and frequencies for cellular telephone frequencies are summarized below:

| f | λ | ½ λ | ¼ λ | 1/16 λ |
|---|---|---|---|---|
| 450 MHz | 64 cm | 32 cm | 16 cm | 4 cm |
| 850 MHz | 33.88 cm | 16.9 cm | 8.47 cm | 2.12 cm |
| 900 MHz | 32 cm | 16 cm | 8 cm | 2 cm |
| 1800 MHz | 16 cm | 8 cm | 4 cm | 1 cm |
| 1900 MHz | 15.16 cm | 7.58 cm | 3.79 cm | 0.95 cm |

The extended varying angle antenna 14 herein is a receiving antenna and does not intentionally transmit electromagnetic energy. Extended varying angle antenna 14 comprises a meandering portion 60 and an extension 61. The meandering portion 60 and extension 61 form a PCB trace antenna comprised of a 1 oz copper microstrip arranged in a serpentine or meandering pattern. PCB trace antennas, microstrips, and methods for making them are well known in the art. PCB 30 has a top surface that includes the microstrip. In the preferred embodiments, the PCB is a standard 0.8 mm FR4 substrate material that is nonconducting at 1.8 GHz. For increased flexibility, a 0.5 mm substrate may be substituted. For example, to allow the PCB antenna to mount to an irregular or rounded cellular telephone or other device, a PCB thickness of 0.5 mm or less is desirable. Rather than using a ground plane in the present device, the antenna 14 is connected to a bridge rectifier which turns the alternating current into direct current for lighting an LED. The microstrip on the top surface of the PCB 30 is preferably less than 0.020 inches wide, and more preferably 0.007 inches wide.

Figure 3:
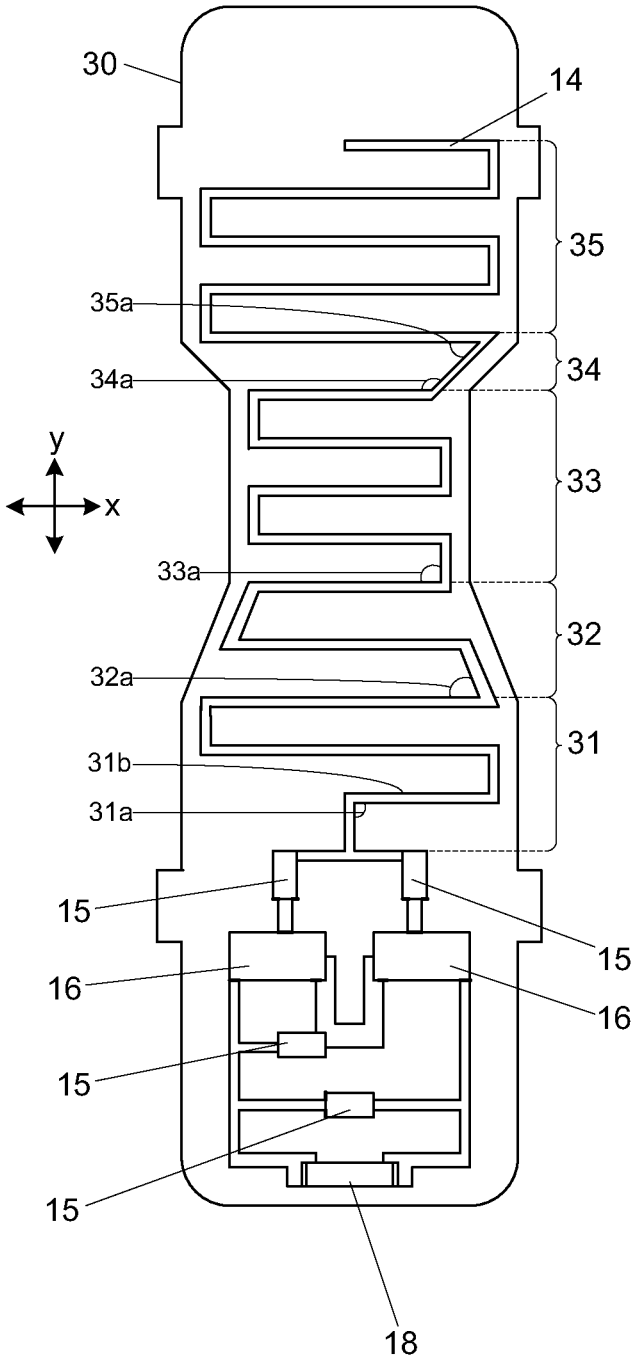
FIG. 3 is a block diagram of a printed circuit board incorporating the meandering portion of the extended antenna of the present invention for use with a cellular telephone.
Figure 4:
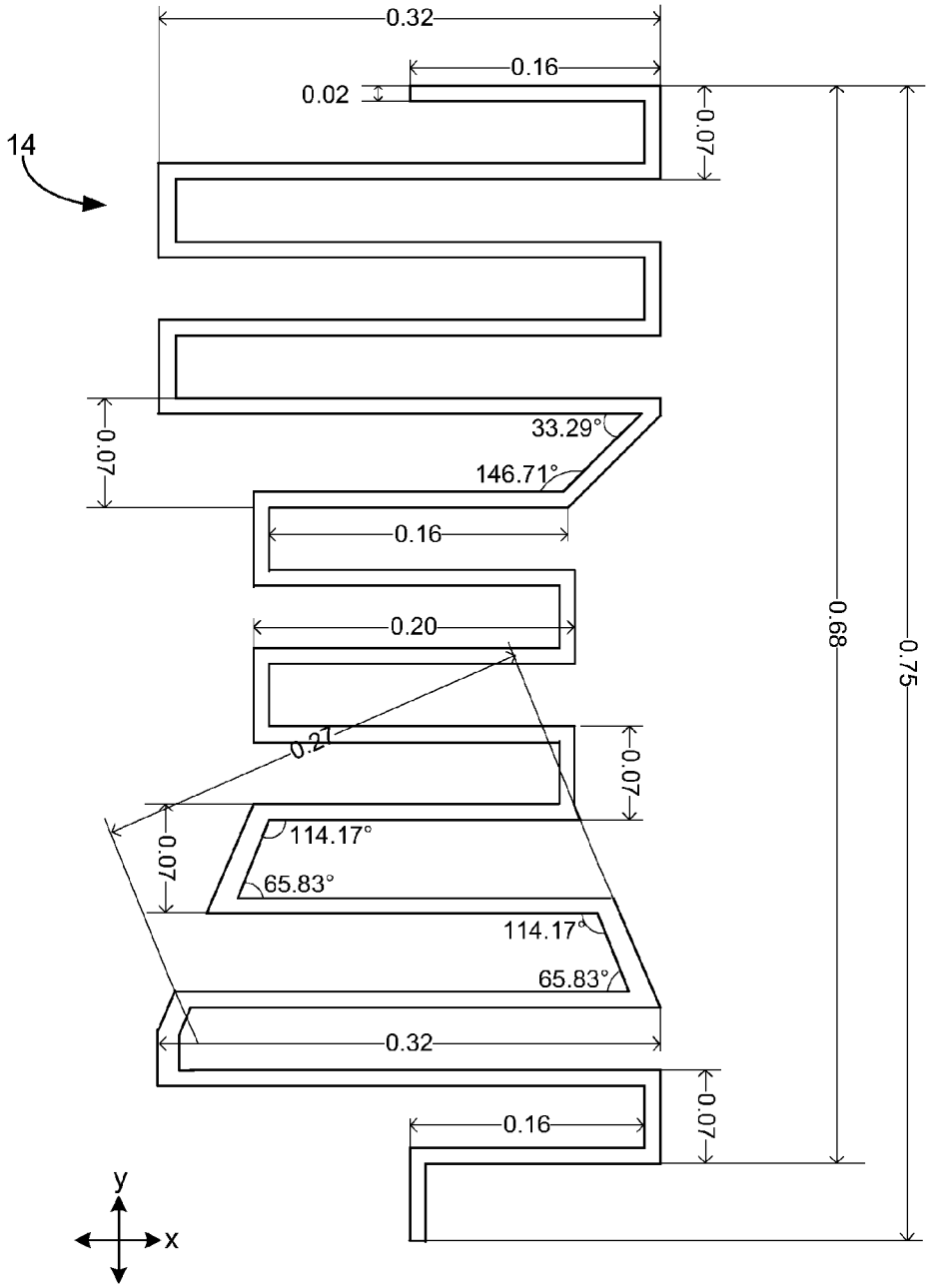
FIG. 4 depicts the preferred dimensions of a meandering portion of the antenna.
Figure 6:
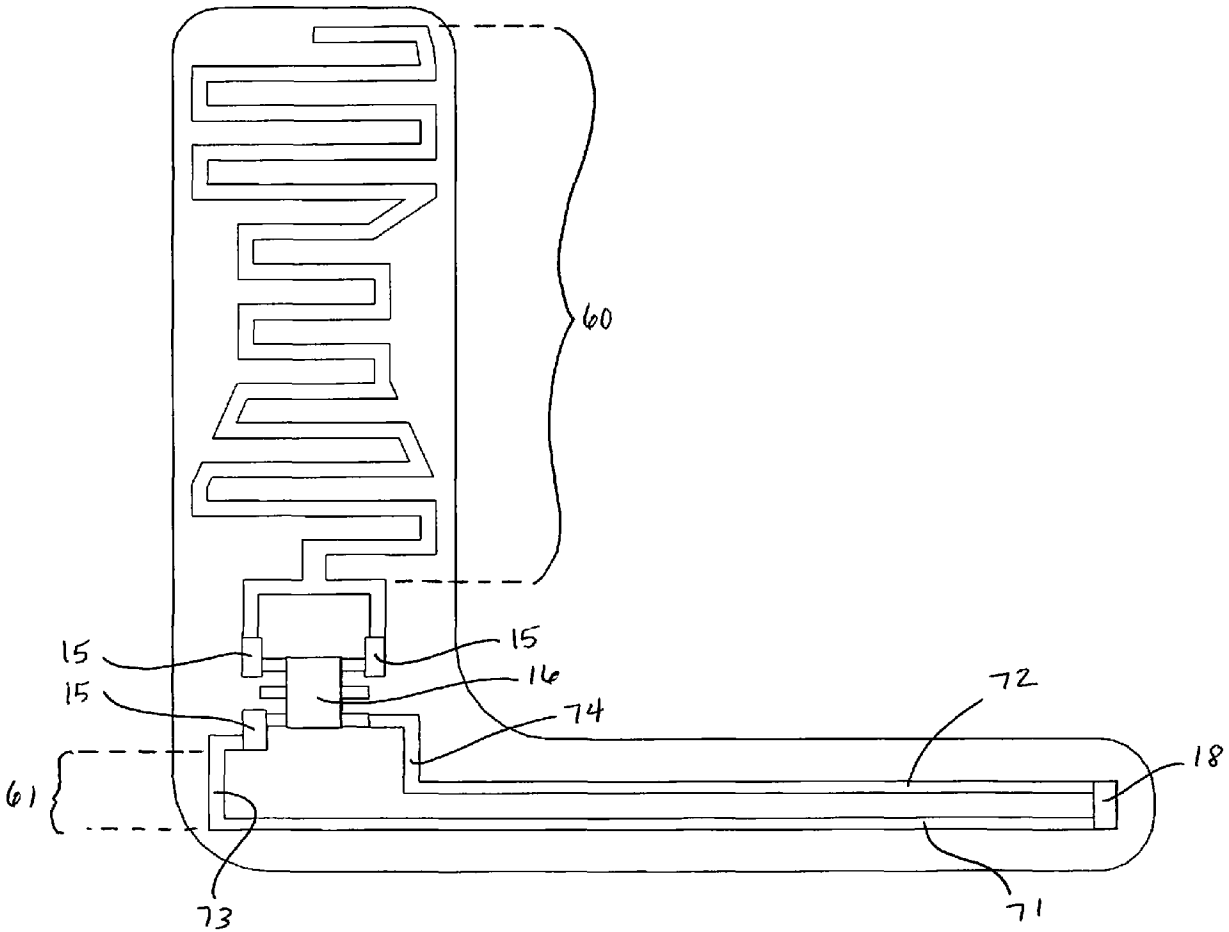
FIG. 6 is a block diagram of a printed circuit board incorporating a preferred embodiment of the extended antenna for use with a cellular telephone.

In a preferred embodiment of the extended varying angle antenna 14, the overall length of the meandering portion 60 in the microstrip is about 3.8 inches, and preferably 3.862 inches. The preferred overall antenna area of copper in the meandering portion 60 is less than 0.08 inches squared. The pattern of the meandering portion 60, as shown in FIGS. 3, 4 and 6, incorporates several 90-degree turns or bends in addition to several turns or bends of greater or lesser degree. The specific dimensions of the segments and angles of the meandering portion 60 are shown in FIG. 4. All of the measurements are in inches in FIG. 4, and the preferred tolerances are ±0.5° for angular measurements and ±0.015 for linear measurements.

Figure 7:
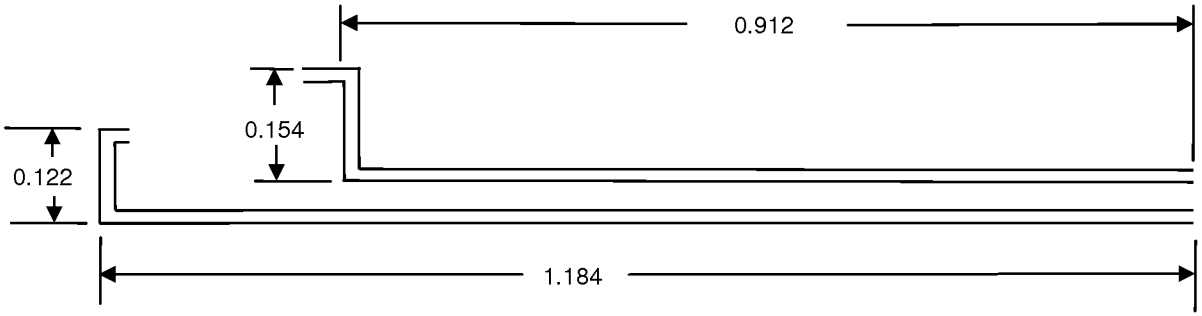
FIG. 7 depicts the preferred dimensions of the extension of the extended antenna shown in FIG. 6.

FIG. 6 shows an extension 61 connected to the meandering portion 60 of antenna 14. Preferably the overall length of the microstrip in the extension 60 is at least about 2.0 inches, and is preferably 2.218 inches. The first horizontal portion 71 has a preferred length of about 1.18 inches and more preferably 1.184 inches. The second horizontal portion 72 has a preferred length of about 0.912 inches and more preferably 0.912 inches. A first vertical portion has a preferred length of about 0.12 inches and more preferably 0.122 inches and a second vertical portion has a preferred length of about 0.15 inches and more preferably 0.154 inches The preferred pattern of the extension 60, as shown in FIGS. 6 and 7, incorporates at least one 90-degree turn or bend. The specific dimensions of the segments and angles of the extension 60 are shown in FIG. 7. All of the measurements are in inches in FIG. 7, and the preferred tolerances are ±0.5 degree for angular measurements and ±0.015 for linear measurements.

The dimensions given for the preferred embodiment shown in FIGS. 4 and 7 are for use in an extended antenna 14 used in connection with a cellular phone operating in the 850 MHz or 1900 MHz bands. Different extension dimensions may be used with cellular phones operating in different bands, such as the 450 MHz, 900 MHz and 1800 MHz bands to more effectively decrease the SARs.

For the sake of convenience and with respect to FIGS. 3, 4, 6 and 7, the portions of extended varying angle antenna 14 that extend in the y direction will be referred to herein as vertical portions (or vertically-oriented portions), and the portions of extended varying angle antenna that extend in the x direction will be referred to herein as horizontal portions (or horizontally-oriented portions). As is shown in FIGS. 3, 4, 6 and 7, all of the horizontal portions of extended varying angle antenna 14 are parallel to one another. The vertical portions, however, can be parallel or angled. In the meandering portion, the vertical portions are consistent in height (or y displacement) for each meander portion. As shown in FIG. 4, they are uniform and 0.07 inches throughout (not all of the heights are shown but should be considered consistent throughout). The horizontal portions and vertical portions are connected to one another at an angle or "bend angle." Bend angles can be any interior angle between 0 degrees and 180 degrees.

FIG. 3 illustrates that the meandering portion of extended varying angle antenna 14 can be broken into several serially connected microstrip segments 31-35. First microstrip segment 31 includes a vertical portion that is coupled at its proximal end to capacitors 15. Segment 31 then bends 90 degrees at bend 31*a* to a horizontal portion 31*b* that is half the overall width of segment 31. Segment 31 then meanders back and forth and includes another four 90-degree bends. In segment 31, the vertical portions are parallel to one another. The distal end of segment 31 is coupled to the proximal end of second microstrip segment 32 bend 32*a* that is less than 90 degrees. Segment 32 tapers from the overall width of segment 31 to a smaller width and includes a meander pattern involving bends greater and less than 90 degrees, such that each vertical portion is angled toward the centerline along the y axis of the meandering portion. The distal end of segment 32 is coupled to the proximal end of third microstrip segment 33 at bend 33*a*. Segment 33 is narrower than segment 31 but includes seven more 90-degree bends. In segment 33, the vertical portions are parallel to one another. The distal end of segment 33 is coupled to the proximal end of fourth microstrip segment 34 at bend 34*a*. Segment 34 tapers from the width of segment 33 to a larger width and includes bends greater and less than 90 degrees, such that the vertical portion is angled away from the center. Finally, the distal end of segment 34 is coupled to the proximal end of fifth microstrip segment 35 at bend 35*a*. Segment 35 is the same overall width as segment 31 and includes eight 90-degree bends. The final portion of segment 35 is horizontal and is one half the length of the other horizontal portions of segment 35. The vertical portions of section 35 are parallel to one another. For the preferred embodiment, there are 21 angles of 90 degrees, 3 angles of less than 90 degrees, and 3 angles of more than 90 degrees. Alternative embodiments can have varying numbers of angles, however the general bottle shape shown in FIGS. 3 and 4 incorporating bends of various angles gives the broadest range of reception.

FIG. 6 illustrates the preferred embodiment of the meandering portion 60 and extension 61. Meandering portion 60 includes microstrip segments 31-35, which are described in detail above. The preferred embodiment of extension 60 includes a first horizontal portion 71 that is coupled at its proximal end to a capacitor 15 using vertical portion 73. The distal end of first horizontal portion 71 is connected to LED 18. Microstrip extension 60 includes a second horizontal portion 72 that is coupled at its proximal end to diode 16, optionally with vertical portion 74. The distal end of first horizontal portion 72 is connected to LED 18. The horizontal portions 71 and 72 are longer than the vertical portions 73 and 74, rendering the long axis of the meandering portion 60 perpendicular to the long axis of extension 61. Alternatively, the horizontal portions 71 and 72 are shorter than the vertical portions 73 and 74, rendering the long axis of the meandering portion 60 parallel to the long axis of extension 61. In this preferred embodiment, the meandering portion is about 3.8 inches long and the extension adds about 2.4 inches, for a total microstrip length of about 6.2 inches.

In another embodiment, the extension 60 is incorporated into the meandering portion 60 of the extended antenna 14 by lengthening one or more of the vertical or horizontal portions in the meandering portion. The effective length of the incorporated extension is preferably a certain length relative to the wavelength of the received radiation. For example, as explained above, if the signal strikes a 32 cm antenna or certain fractions of it (½ or ¼ or 1/16 wavelength), then the induced current will be much higher than if the signal struck a target antenna that was not some appreciable fraction of the wavelength. Increased current is thus applied to the dissipation assembly 17, enabling it to operate longer, brighter, or other ways that utilize a larger current.

In another embodiment, the extension 61 is connected in parallel with the meandering portion 60 to the dissipation assembly 17. This embodiment may be particularly useful if more than one dissipation assembly is used, and enables the voltage drop to remain uniform across both dissipation assemblies.

Extended varying angle antenna 14 cooperates with dissipation assembly 17 of dissipation device 10 to effectively decrease the SARs to the user of a cellular telephone without significantly adversely affecting the transmission from the cellular telephone to the cell tower, or base station. As shown in FIGS. 3 and 6, extended varying angle antenna 14 is connected to capacitors 15 and diodes 16, to drive the LED 18. This further permits the dissipation device to also indicate to its user that electromagnetic radiation is present or that the device used to reduce SARs is working. The capacitors and diodes act as a voltage multiplier to generate sufficient voltage to drive the LED 18. For example, in the low-level application shown in FIG. 3, four capacitors 15 are used with two diodes 16. In the low-level application shown in FIG. 6, 3 capacitors 15 are used with 1 diode 16. Preferably the capacitors are 1.0 uf, 6 VDC ceramic capacitors such as the AVX 0603ZD105KAT2A available from AVX of Myrtle Beach, S.C. Additionally, the LED is preferably a low current 632 nm red LED such as the APT1608SEWE available from Kingbright Corp. of City of Industry, Calif. Preferably the diodes 16 are high-frequency RF Schottky diodes, which have a very low forward voltage of about 0.2-0.3 V. Such diodes are available commercially from, for example, Aeroflex/Metelics, Inc. of Sunnyvale, Calif. The number of capacitors and diodes can be increased or decreased as necessary when cooperating with emission sources of different levels of radiation. For example, when reducing undesirable emission from an emission sources emanating higher energy, such as shortwave radio, the number of capacitors can be reduced because the voltage draining off the antenna is itself sufficient to drive a dissipater assembly. Similarly, the amperage and voltage rating of the diodes, and the capacitance of the capacitors, can be increased or decreased as necessary.

The collected current can be used to operate any dissipation assembly 17, which is defined as one or more users of current. For example, the dissipation assembly 17 can be one or more of a buzzer, bell or any other transducer that converts electrical energy to sound; motor or any other transducer that converts electrical energy to motion; heater or any other transducer that converts electrical energy to heat; lamp or any transducer that converts electrical energy to light; or a combination thereof. The current may be used to catalyze a chemical reaction. In the preferred embodiment, the current is directed to an LED that lights up when supplied with the current, serving a secondary purpose of showing the user when the device 10 is working or when electromagnetic radiation is present. In another embodiment, the current is directed to an LCD display. The dissipation assembly 17 may be used to operate one or more users of current within the emission source 11. Adding the extension 61 to the meandering portion 60 enables more radiation to be captured than in a meandering portion 60 alone, thus generating a larger electric current in the antenna 14 than in the meandering portion 60 alone. This in turn enables the device to power dissipation assemblies requiring more current or voltage. For example, when an LED is used as the dissipation assembly, more current will cause the LED to shine brighter, indicating to the user more robust operation.

Figure 5:
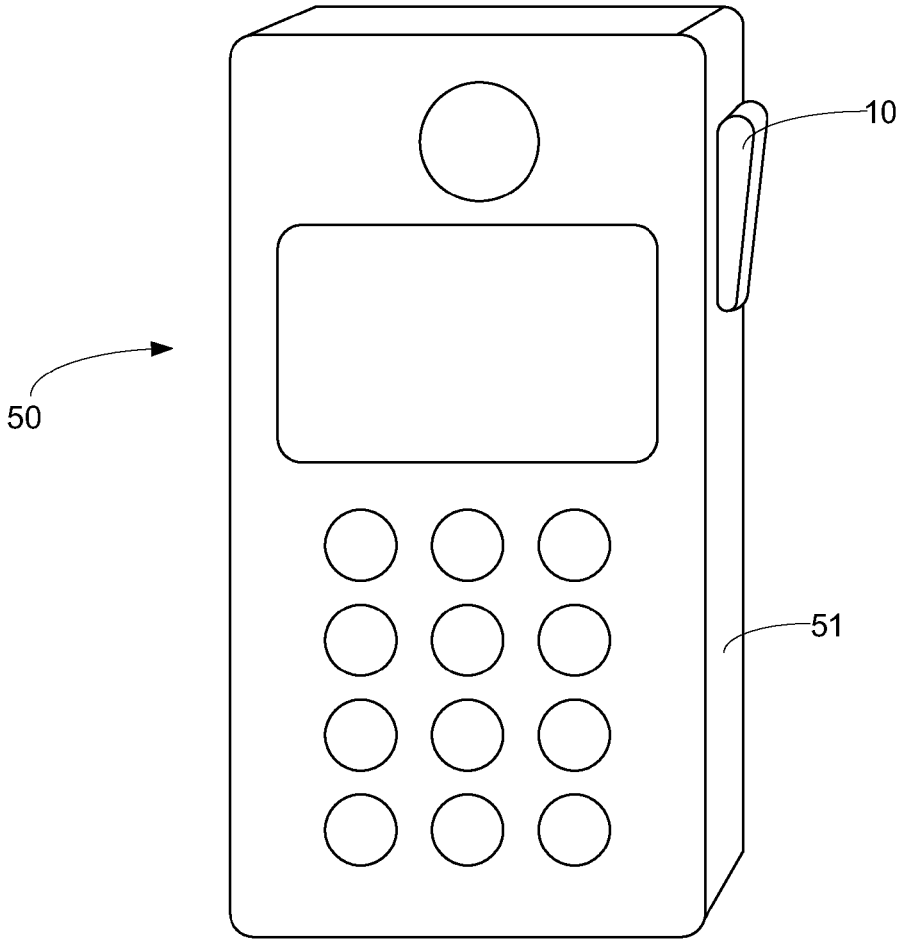
FIG. 5 is a perspective view of a cellular telephone with the electromagnetic radiation dissipation device adhered to the outside shell.

FIG. 5 illustrates device 10 incorporating the extended varying angle antenna 14 as it is applied to a cellular telephone 50. Cellular telephone 50 is the electromagnetic emission source 11. Dissipation device 10 does not have to be connected in any way to the emission source 11. For example, in the preferred embodiments, the dissipation device 10 is not connected electrically to the cellular telephone 50. Additionally, dissipation device 10 can simply rest near cellular telephone 50 by being worn on a person's clothing or integrated into accessories, such as jewelry, lanyards, hats or scarves. Preferably, however, dissipation device 10 is connected physically to the emission source 11, simply so that dissipation device 10 does not inadvertently get separated from the emission source 11 and stop functioning as intended. For example, dissipation device 10 may be adhesively attached to the outer housing 51 of the cellular telephone 50, as shown in FIG. 5. Dissipation device 10 may be attached to the emission source 11 using other mechanisms, such as a screw, pin, compression or friction fit, for example, or dissipation device 10 may be integrally formed with the emission source 11. Regardless of whether dissipation device 10 is physically attached to emission source 11, it must be within a certain distance to capture the undesirable radiation. This distance depends on a number of factors, including the emission frequency, power, medium through which the radiation is traveling, etc. The acceptable distance 20 is symbolically indicated in FIG. 2 with the dotted line. Preferably, the dissipation device 10 is positioned within 6 inches of a cellular telephone or other emission source.

In addition to use with cellular telephones, the present invention may be used with other emission sources such as other wireless communication devices such as satellite phones, BlackBerry® and other email-transmitting devices; wide area wireless local area networks; microwave ovens; portable radios, music players, and video players; automatic garage door and building door openers; police radar guns; short-wave and other ham radios; televisions or other cathode ray tube and plasma displays; power transmission lines; radioactive chemicals; or any other emission source. The present invention may also be used to indicate when electromagnetic radiation is present yet the emission source is unknown.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. An extended varying angle antenna that reduces undesired electromagnetic radiation emanating from an active emission source, the antenna comprising a microstrip disposed on a printed circuit board, wherein the microstrip comprises:

a. a first meandering portion with at least one meandering segment having a first horizontal length;

b. a second meandering portion serially connected to the first meandering portion, the second meandering portion having at least one meandering segment having a second horizontal length that is less than the first horizontal length;

c. a third meandering portion serially connected to the second meandering portion, the third meandering portion having at least one meandering segment having a third horizontal length that is more than the second horizontal length; and d. an extension connected to the third meandering portion; wherein the first, second and third meandering portions comprise at least three meandering segments and wherein:

i. two or more meandering segments comprise 90-degree bends;

ii. one or more meandering segments comprise bends not equal to 90 degrees;

iii. at least one meandering segment comprising bends not equal to 90 degrees comprises at least one bend greater than 90 degrees and at least one bend less than 90 degrees; and iv. at least one meandering segment comprising bends equal to 90 degrees comprises three or more bends, each bend being equal to 90 degrees.

2. The device of claim 1 wherein the sum of the lengths of the first, second and third meandering portions of the microstrip is about 3.8 inches.

3. The device of claim 1 wherein the length of the extension is about 2.4 inches.

4. The device of claim 1 wherein the extension further comprises a first horizontal portion having a length of about 1.18 inches and a second horizontal portion having a length of about 0.91 inches.

5. The device of claim 4 wherein the extension further comprises a first vertical portion having a length of about 0.12 inches and a second vertical portion having a length of about 0.15 inches.

6. The device of claim 1 wherein the dissipation assembly comprises one or more of an electrical, mechanical or thermal device.

7. The device of claim 1 wherein the dissipation assembly comprises a light emitting diode.

8. The device of claim 1 wherein the extended varying angle antenna is not electrically connected to the active emission source.

9. The device of claim 1 wherein the active emission source is a cellular telephone.

* * * * *